US007596486B2

(12) United States Patent
Ojala et al.

(10) Patent No.: US 7,596,486 B2
(45) Date of Patent: Sep. 29, 2009

(54) ENCODING AN AUDIO SIGNAL USING DIFFERENT AUDIO CODER MODES

(75) Inventors: Pasi Ojala, Kauniainen (FI); Jari Mäkinen, Tampere (FI); Ari Lakaniemi, Helsinki (FI)

(73) Assignee: Nokia Corporation, Espoo (FI)

( * ) Notice: Subject to any disclaimer, the term of this patent is extended or adjusted under 35 U.S.C. 154(b) by 1117 days.

(21) Appl. No.: 10/848,971

(22) Filed: May 19, 2004

(65) Prior Publication Data

US 2005/0261900 A1 Nov. 24, 2005

(51) Int. Cl.
*G10L 19/00* (2006.01)

(52) U.S. Cl. ..... 704/201; 704/501

(58) Field of Classification Search ..... 704/201, 704/501

See application file for complete search history.

(56) References Cited

U.S. PATENT DOCUMENTS 5,857,168 A * 1/1999 Ozawa ..... 704/229
6,300,888 B1 * 10/2001 Chen et al. ..... 341/63
6,369,855 B1 * 4/2002 Chauvel et al. ..... 348/423.1
6,424,936 B1 * 7/2002 Shen et al. ..... 704/200.1
6,475,245 B2 * 11/2002 Gersho et al. ..... 704/208
6,658,383 B2 * 12/2003 Koishida et al. ..... 704/229
6,785,645 B2 * 8/2004 Khalil et al. ..... 704/216
7,315,815 B1 * 1/2008 Gersho et al. ..... 704/223

OTHER PUBLICATIONS

The adaptive multirate wideband speech codec (AMR-WB); Bessette, B. Salami, R. Lefebvre, R. Jelinek, M. Rotola-Pukkila, J. Vainio, J. Mikkola, H. Jarvinen, K.; Speech and Audio Processing, IEEE Transactions on;Publication Date: Nov. 2002;vol. 10, Issue: 8 On pp. 620-636.*

The adaptive multirate wideband speech codec: system characteristics, quality advances, and deployment strategies; Ojala, P. Lakaniemi, A. Lepanaho, H. Jokimies, M.; Communications Magazine, IEEE Publication Date: May 2006 vol. 44, Issue: 5 On pp. 59-65.*

(Continued)

*Primary Examiner*—Michael N Opsasnick
(74) *Attorney, Agent, or Firm*—Alfred A. Fressola; Ware, Fressola, Van Der Sluys & Adolphson LLP

(57) ABSTRACT

The invention relates to a method for supporting an encoding of an audio signal, wherein a first coder mode and a second coder mode are available for encoding a respective section of an audio signal. The second coder mode enables a coding of a respective section based on a first coding model, which requires for an encoding of a respective section only information from the section itself, and based on a second coding model, which requires for an encoding of a respective section in addition an overlap signal with information from a preceding section. After a switch from the first coder mode to the second coder mode, always the first coding model is used for encoding a first section of the audio signal. This section can then be employed to generate an artificial overlap signal for a subsequent section, which is possibly to be encoded with the second coding model.

28 Claims, 5 Drawing Sheets

OTHER PUBLICATIONS

3rd Generation Partnership Project, Technical Specification, Group Services and System Aspects, "Speech Codec speech processing functions; AMR Wideband speech codec; Transcoding functions," Release 5, 3GPP TS 26.190, version 5.1.0 (Dec. 2001), 53 pages.

"Bridging the Gap Between Speech and Audio Coding AMR-WB +—The Codec for Mobile Audio;" S. Bruhn; Ericsson; May 10, 2004; pp. 19-41.

"A Wideband Speech and Audio Codec at 16/24/32 kbit/s Using Hybrid ACELP/TCX Techniques;" Speech Coding Proceedings, 1999 IEEE Workshop on Porvoo, Finland; Jun. 20-23, 1999.

J. Makinen, et al; "Source signal based rate adaptation for GSM ASR speech codec"; Information Technology: Coding and Computing, 2004; Proceedings, ITCC 2004; International Conference in Las Vegas, NV, Apr. 5-7, 2004; Piscataway, NJ, IEEE; vol. 2, pp. 308-313; whole document.

I. Varga; "Audio codec for mobile multimedia applications"; Multimedia Signal Processing, 2004 IEEE 6th Workshop in Siena, Italy, Sep. 29-Oct. 1, 2004; Piscataway, NJ, IEEE, Sep. 29, 2004; pp. 450-453; whole document.

* cited by examiner

ENCODING AN AUDIO SIGNAL USING DIFFERENT AUDIO CODER MODES

FIELD OF THE INVENTION

The invention relates to a method for supporting an encoding of an audio signal, wherein at least a first coder mode and a second coder mode are available for encoding a respective section of the audio signal, and wherein at least the second coder mode enables a coding of a respective section of the audio signal based on at least two different coding models. The invention relates equally to a corresponding module, to an electronic device comprising a corresponding encoder and to an audio coding system comprising a corresponding encoder and a decoder. Finally, the invention relates as well to a corresponding software program product.

BACKGROUND OF THE INVENTION

An audio signal can be a speech signal or another type of audio signal, like music, and for different types of audio signals different coding models might be appropriate.

A widely used technique for coding speech signals is the Algebraic Code-Excited Linear Prediction (ACELP) coding. ACELP models the human speech production system, and it is very well suited for coding the periodicity of a speech signal. As a result, a high speech quality can be achieved with very low bit rates. Adaptive Multi-Rate Wideband (AMR-WB), for example, is a speech codec which is based on the ACELP technology. AMR-WB has been described for instance in the technical specification 3GPP TS 26.190: "Speech Codec speech processing functions; AMR Wideband speech codec; Transcoding functions", V5.1.0 (2001-12). Speech codecs which are based on the human speech production system, however, perform usually rather badly for other types of audio signals, like music.

A widely used technique for coding other audio signals than speech is transform coding (TCX). The superiority of transform coding for audio signal is based on perceptual masking and frequency domain coding. The quality of the resulting audio signal can be further improved by selecting a suitable coding frame length for the transform coding. But while transform coding techniques result in a high quality for audio signals other than speech, their performance is not good for periodic speech signals when operating at low bitrates. Therefore, the quality of transform coded speech is usually rather low, especially with long TCX frame lengths.

The extended AMR-WB (AMR-WB+) codec encodes a stereo audio signal as a high bitrate mono signal and provides some side information for a stereo extension. The AMR-WB+ codec utilizes both, ACELP coding and TCX models to encode the core mono signal in a frequency band of 0 Hz to 6400 Hz. For the TCX model, a coding frame length of 20 ms, 40 ms or 80 ms is utilized.

Since an ACELP model can degrade the audio quality and transform coding performs usually poorly for speech, especially when long coding frames are employed, the respectively best coding model has to be selected depending on the properties of the signal which is to be coded. The selection of the coding model which is actually to be employed can be carried out in various ways.

In systems requiring low complex techniques, like mobile multimedia services (MMS), usually music/speech classification algorithms are exploited for selecting the optimal coding model. These algorithms classify the entire source signal either as music or as speech based on an analysis of the energy and the frequency properties of the audio signal.

If an audio signal consists only of speech or only of music, it will be satisfactory to use the same coding model for the entire signal based on such a music/speech classification. In many other cases, however, the audio signal which is to be encoded is a mixed type of audio signal. For example, speech may be present at the same time as music and/or be temporally alternating with music in the audio signal.

In these cases, a classification of entire source signals into music or speech category is a too limited approach. The overall audio quality can then only be maximized by temporally switching between the coding models when coding the audio signal. That is, the ACELP model is partly used as well for coding a source signal classified as an audio signal other than speech, while the TCX model is partly used as well for a source signal classified as a speech signal.

The extended AMR-WB (AMR-WB+) codec is designed as well for coding such mixed types of audio signals with mixed coding models on a frame-by-frame basis.

The selection, that is, the classification, of coding models in AMR-WB+ can be carried out in several ways.

In the most complex approach, the signal is first encoded with all possible combinations of ACELP and TCX models. Next, the signal is synthesized again for each combination. The best excitation is then selected based on the quality of the synthesized speech signals. The quality of the synthesized speech resulting with a specific combination can be measured for example by determining its signal-to-noise ratio (SNR). This analysis-by-synthesis type of approach will provide good results. In some applications, however, it is not practicable, because of its very high complexity. Such applications include, for example, mobile applications. The complexity results largely from the ACELP coding, which is the most complex part of an encoder.

In systems like MMS, for example, the above mentioned full closed-loop analysis-by-synthesis approach is far too complex to perform. In an MMS encoder, therefore, lower complexity open-loop methods may be employed in the classification for determining whether an ACELP coding model or a TCX model is to be used for encoding a particular frame.

AMR-WB+ may use various low-complex open-loop approaches for selecting the respective coding model for each frame. The selection logic employed in such approaches aims at evaluating the source signal characteristics and encoding parameters in more detail for selecting a respective coding model.

One proposed selection logic within a classification procedure involves first splitting up an audio signal within each frame into several frequency bands, and analyzing the relation between the energy in the lower frequency bands and the energy in the higher frequency bands, as well as analyzing the energy level variations in those bands. The audio content in each frame of the audio signal is then classified as a music-like content or a speech-like content based on both of the performed measurements or on different combinations of these measurements using different analysis windows and decision threshold values.

In another proposed selection logic aiding the classification, which can be used in particular in addition to the first selection logic and which is therefore also referred to as model classification refinement, the coding model selection is based on an evaluation of the periodicity and the stationary properties of the audio content in a respective frame of the audio signal. Periodicity and stationary properties are evaluated more specifically by determining correlation, Long Term Prediction (LTP) parameters and spectral distance measurements.

The AMR-WB+ codec allows in addition to switch during the coding of an audio stream between AMR-WB modes, which employ exclusively an ACELP coding model, and extension modes, which employ either an ACELP coding model or a TCX model, provided that the sampling frequency does not change. The sampling frequency can be for example 16 kHz.

The extension modes output a higher bit rate than the AMR-WB modes. A switch from an extension mode to an AMR-WB mode can thus be of advantage when transmission conditions in the network connecting the encoding end and the decoding end require a changing from a higher bit-rate mode to a lower bit-rate mode to reduce congestion in the network. A change from a higher bit-rate mode to a lower bit-rate mode might also be required for incorporating new low-end receivers in a Mobile Broadcast/Multicast Service (MBMS).

A switch from an AMR-WB mode to an extension mode, on the other hand, can be of advantage when a change in the transmission conditions in the network allows a change from a lower bit-rate mode to a higher bit-rate mode. Using a higher bit-rate mode enables a better audio quality.

Since the core codec use the same sampling rate of 6.4 kHz for the AMR-WB modes and the AMR-WB+ extension modes and employs at least partially similar coding techniques, a change from an extension mode to an AMR-WB mode, or vice versa, at this frequency band can be handled smoothly. As the ACELP core-band coding process is slightly different for an AMR-WB mode and an extension mode, it has to be taken care, however, that all required state variables and buffers are stored and copied from one algorithm to the other when switching between the coder modes.

Further, it has to be taken into account that a transform model can only be used in the extension modes.

For encoding a specific coding frame, the TCX model makes use of overlapping windows. This is illustrated in FIG. 1. FIG. 1 is a diagram presenting a time line with a plurality of coding frames and a plurality overlapping analysis windows. For coding a TCX frame, a window covering the current TCX frame and a preceding TCX frame is used. Such a TCX frame 11 and a corresponding overlapping window 12 are indicated in the diagram with solid bold lines. The next TCX frame 13 and a corresponding window 14 are indicated in the diagram with dashed bold lines. In the presented example, the analysis windows are overlapping by 50%, even though in practice, the overlap is usually smaller.

In a typical operation within the AMR-WB extension mode, an overlapping signal for the respective next frame is generated based on information on the current frame after the current frame has been encoded.

When the transform coding model is used for a current coding frame, the overlapping signal for a next coding frame is generated by definition, since the analysis windows for the transform are overlapping.

The ACELP coding model, in contrast, relies only on information from the current coding frame, that is, it does not use overlapping windows. If a ACELP coding frame is followed by an TCX frame, the ACELP algorithm is therefore required to generate an overlap signal artificially, that is, in addition to the actual ACELP related processing.

FIG. 2 presents a typical situation in an extension mode, in which an artificial overlap signal has to be generated for a TCX frame, because it follows upon an ACELP frame. The ACELP coding frame 21 and the artificial overlap signal 22 for the TCX frame 23 are indicated with dashed bold lines. The TCX frame 23 and the overlap signal 24 from and for the TCX frame 23 are indicated with solid bold lines. Since ACELP coding does not require any overlapping signal from the previous coding frame, no overlapping signal is generated, if an ACELP frame is followed by a further ACELP frame.

In the AMR-WB extension modes, the artificial overlap signal generation in the ACELP mode is a built-in feature. Hence, the switching between ACELP coding and TCX is smooth.

There remains a problem, however, when switching at an AMR-WB+codec from a standard AMR-WB mode to an extension mode. The standard AMR-WB mode does not provide any artificial overlap signal generation, since an overlap signal is not needed in this coder mode. Hence, if the audio signal frame after a switch from an AMR-WB mode to an extension mode is selected to be a TCX frame, the coding cannot be performed properly. As a result, the missing overlapping signal part will cause audible artifacts in the synthesis of the audio signal.

SUMMARY OF THE INVENTION

It is an object of the invention to enable a smooth switching between different coder modes.

In accordance with a first aspect of the invention, a method for supporting an encoding of an audio signal is proposed, wherein at least a first coder mode and a second coder mode are available for encoding a respective section of the audio signal. At least the second coder mode enables a coding of a respective section of the audio signal based on at least two different coding models. A first one of the coding models requires for an encoding of a respective section of the audio signal only information from the section itself, while a second one of the coding models requires for an encoding of a respective section of the audio signal in addition an overlap signal with information from a preceding section of the audio signal. After a switch from the first coder mode to the second coder mode, the first coding model is used for encoding a first section of the audio signal. For further sections of the audio signal, the respectively best suited coding model is selected.

Moreover, an artificial overlap signal is generated based on information from the first section, at least in case the second coding model is selected for encoding a subsequent section of the audio signal. The respectively selected coding model is then used for encoding the further sections.

In accordance with the first aspect of the invention, moreover a module for encoding consecutive sections of an audio signal is proposed. The module comprises a first coder mode portion adapted to encode a respective section of an audio signal, and a second coder mode portion adapted to encode a respective section of an audio signal. The module further comprises a switching portion adapted to switch between the first coder mode portion and the second coder mode portion for encoding a respective section of an audio signal. The second coder mode portion includes a selection portion adapted to select for a respective section of an audio signal one of at least two different coding models, wherein a first one of these coding models requires for encoding a respective section of an audio signal only information from the section itself, while a second one of these coding models requires for encoding a respective section of an audio signal in addition an overlap signal with information from a preceding section of the audio signal. The selection portion is further adapted to select for a first section of an audio signal after a switch to the second coder mode portion always the first coding model. The second coder mode portion further includes an encoding portion which is adapted to encode a respective section of an audio signal based on a coding model selected by the selection portion. The encoding portion is further adapted to generate an artificial overlap signal with information from a first section of an audio signal after a switch to the second coder mode portion, at least in case the second coding model has been selected for encoding a subsequent section of the audio signal.

In accordance with the first aspect of the invention, moreover an electronic device comprising an encoder with the features of the proposed module is proposed.

In accordance with the first aspect of the invention, moreover an audio coding system comprising an encoder with the features of the proposed module and in addition a decoder for decoding consecutive encoded sections is proposed.

In accordance with the first aspect of the invention, finally a software program product is proposed, in which a software code for supporting an encoding of an audio signal is stored. At least a first coder mode and a second coder mode are available for encoding a respective section of the audio signal, and at least the second coder mode enables a coding of a respective section of the audio signal based on at least two different coding models. A first one of these coding models requires for an encoding of a respective section of the audio signal only information from the section itself, while a second one of these coding models requires for an encoding of a respective section of the audio signal in addition an overlap signal with information from a preceding section of the audio signal. When running in a processing component of an encoder, the software code realizes the proposed method after a switch from the first coder mode to the second coder mode.

The first aspect of the invention is based on the idea that the presence of an overlapping signal, which is based on a preceding audio signal section, can be ensured for each section for which a coding model requiring such an overlapping signal is selected, if this coding model can never be selected as a coding model for a first section of an audio signal in a particular coder mode. It is therefore proposed that after a switch to the second coder mode which enables the use of a coding model requiring an overlapping signal and of a coding model not requiring an overlapping signal, the coding model not requiring an overlapping signal is always selected for encoding the first audio signal section.

It is an advantage of the first aspect of the invention that it ensures a smooth switch from the first coder mode to the second coder mode, as it prevents the use of an invalid overlapping signal.

A switch from the second coder mode to the first coder mode can be performed without such a precaution, in case the first coder mode allows only the use of the first coding model. The quantization for different coding models might be different, however. If the quantization tools are not initialized properly before a switch, this may result in audible artifacts in the audio signal sections after a switching because of the different coding methods. Therefore, it is of advantage to ensure before a switch from the second coder mode to the first coder mode that the quantization tools are initialized properly. The initialization may comprise for instance the provision of an appropriate initial quantization gain, which is stored in some buffer.

A second aspect of the invention is based on the idea that this can be achieved by ensuring that before a switch from the second coder mode to the first coder mode, the first coding model is used for encoding a last section of the audio signal in the second coder mode. That is, when a decision has been taken that a switch is to be performed from the second coder mode to the first coder mode, the actual switch is delayed by at least one audio signal section.

In accordance with the second aspect of the invention, thus a method for supporting an encoding of an audio signal is proposed, wherein at least a first coder mode and a second coder mode are available for encoding a respective section of the audio signal. At least the second coder mode enables a coding of a respective section of the audio signal based on at least two different coding models. A first one of the coding models requires for an encoding of a respective section of the audio signal only information from the section itself, while a second one of the coding models requires for an encoding of a respective section of the audio signal in addition an overlap signal with information from a preceding section of the audio signal. Before a switch from the second coder mode to the first coder mode, the first coding model is used for encoding a last section of the audio signal before the switch.

In accordance with the second aspect of the invention, moreover a module for encoding consecutive sections of an audio signal is proposed. The module comprises a first coder mode portion adapted to encode a respective section of an audio signal, and a second coder mode portion adapted to encode a respective section of an audio signal. The module further comprises a switching portion adapted to switch between the first coder mode portion and the second coder mode portion for encoding a respective section of an audio signal. The second coder mode portion includes a selection portion adapted to select for a respective section of an audio signal one of at least two different coding models, wherein a first one of these coding models requires for encoding a respective section of an audio signal only information from the section itself, while a second one of these coding models requires for encoding a respective section of an audio signal in addition an overlap signal with information from a preceding section of the audio signal. The selection portion is further adapted to select for a last section of an audio signal before a switch to the first coder mode portion always the first coder model.

In accordance with the second aspect of the invention, moreover an electronic device is proposed which comprises an encoder with the features of the module proposed for the second aspect of the invention.

In accordance with the second aspect of the invention, moreover an audio coding system is proposed, which comprises an encoder with the features of the module proposed for the second aspect of the invention and in addition a decoder for decoding consecutive encoded sections.

In accordance with the second aspect of the invention, finally a software program product is proposed, in which a software code for supporting an encoding of an audio signal is stored. At least a first coder mode and a second coder mode are available for encoding a respective section of the audio signal, and at least the second coder mode enables a coding of a respective section of the audio signal based on at least two different coding models. A first one of these coding models requires for an encoding of a respective section of the audio signal only information from the section itself, while a second one of these coding models requires for an encoding of a respective section of the audio signal in addition an overlap signal with information from a preceding section of the audio signal. When running in a processing component of an encoder, the software code realizes the proposed method according to the second aspect of the invention in case of a switch from the second coder mode to the first coder mode.

It is an advantage of the second aspect of the invention that it ensures a smooth switch from the second coder mode to the first coder mode, as it allows a proper initialization of the quantization tools for the first coder mode.

Both aspects of the invention are thus based on the consideration that a smooth switching can be achieved by overrunning in the second coder mode the conventional selection between a first coding model and a second coding model, either in the first section of an audio signal after a switch or in the last section of an audio signal before a switch, respectively.

It is to be understood that both aspects of the invention can be implemented together, but equally independently from each other.

For both aspects of the invention, the first coding model can be for instance a time-domain based coding model, like an ACELP coding model, while the second coding model can be for instance a frequency-domain based coding model, like a TCX model. Moreover, the first coder mode can be for example an AMR-WB mode of an AMR-WB+ codec, while the second coder mode can be for example an extension mode of the AMR-WB+ codec.

The proposed module can be for both aspects of the invention for instance an encoder or a part of an encoder.

The proposed electronic device can be for both aspects of the invention for instance a mobile communication device or some other mobile device which requires a low classification complexity. It is to be understood that the electronic device can be equally a non-mobile device, though.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
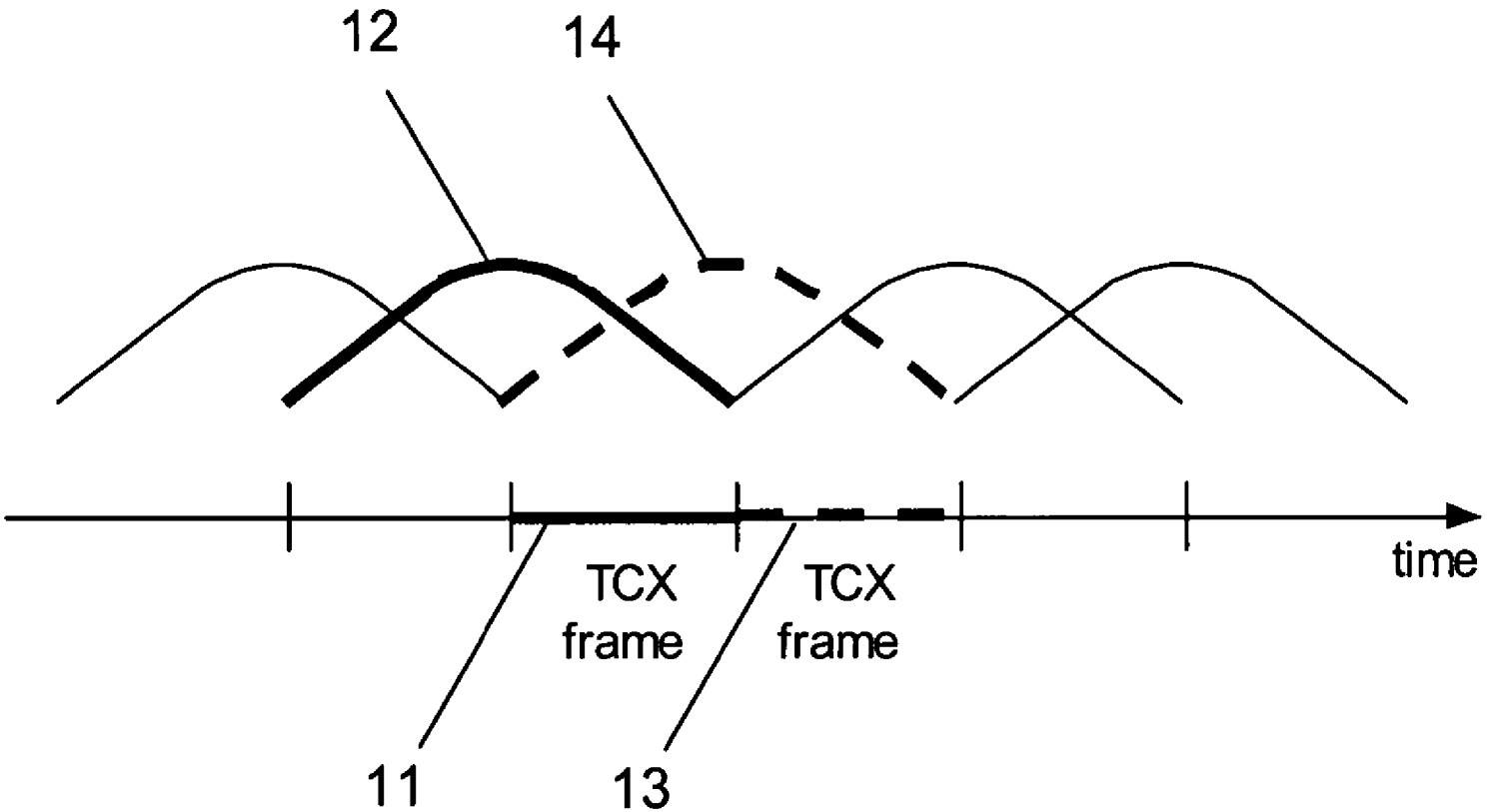
FIG. 1 is a diagram illustrating overlapping windows used in TCX.
Figure 2:
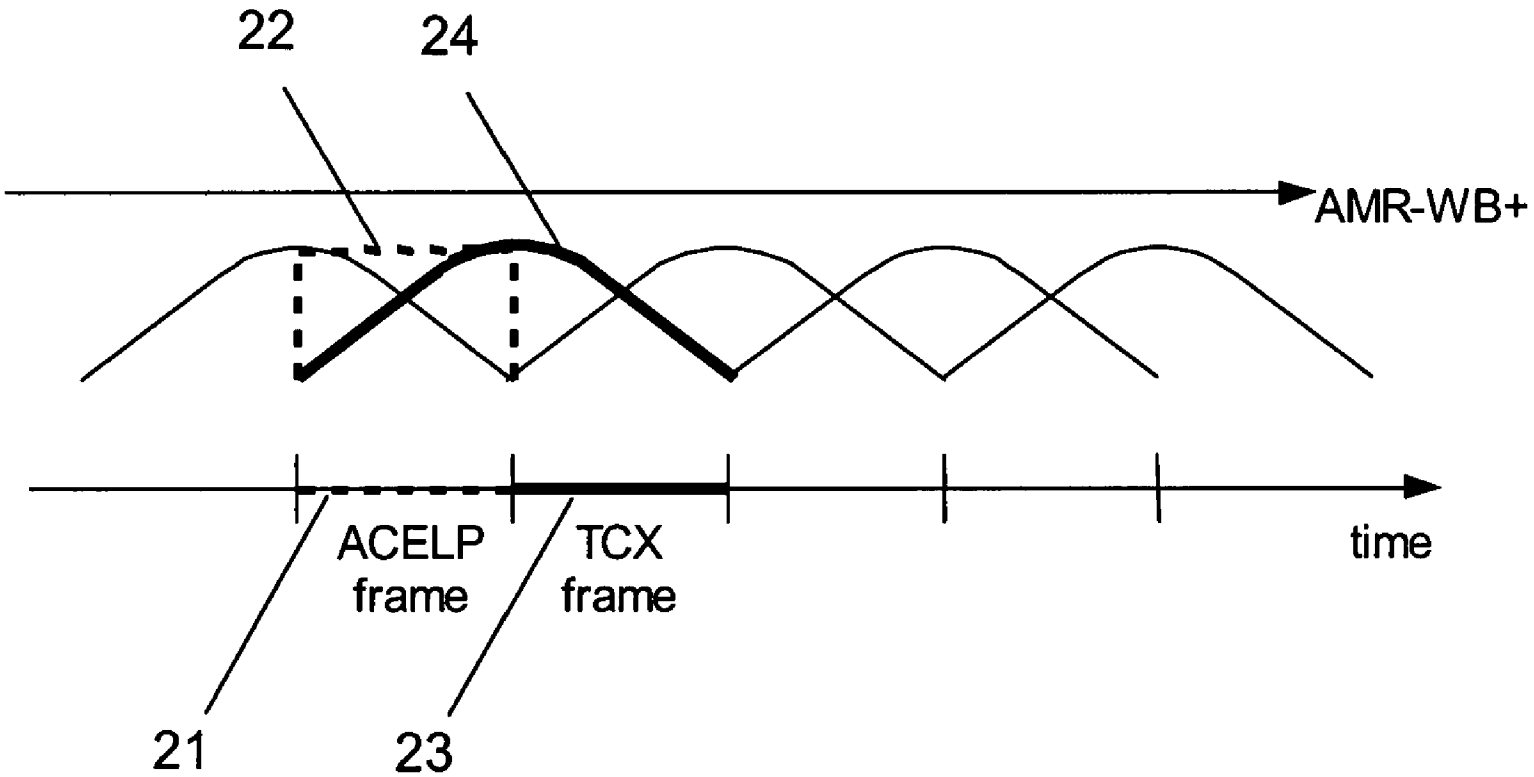
FIG. 2 is a diagram illustrating a conventional switching from ACELP coding to TCX in AMR-WB+mode.
Figure 3:
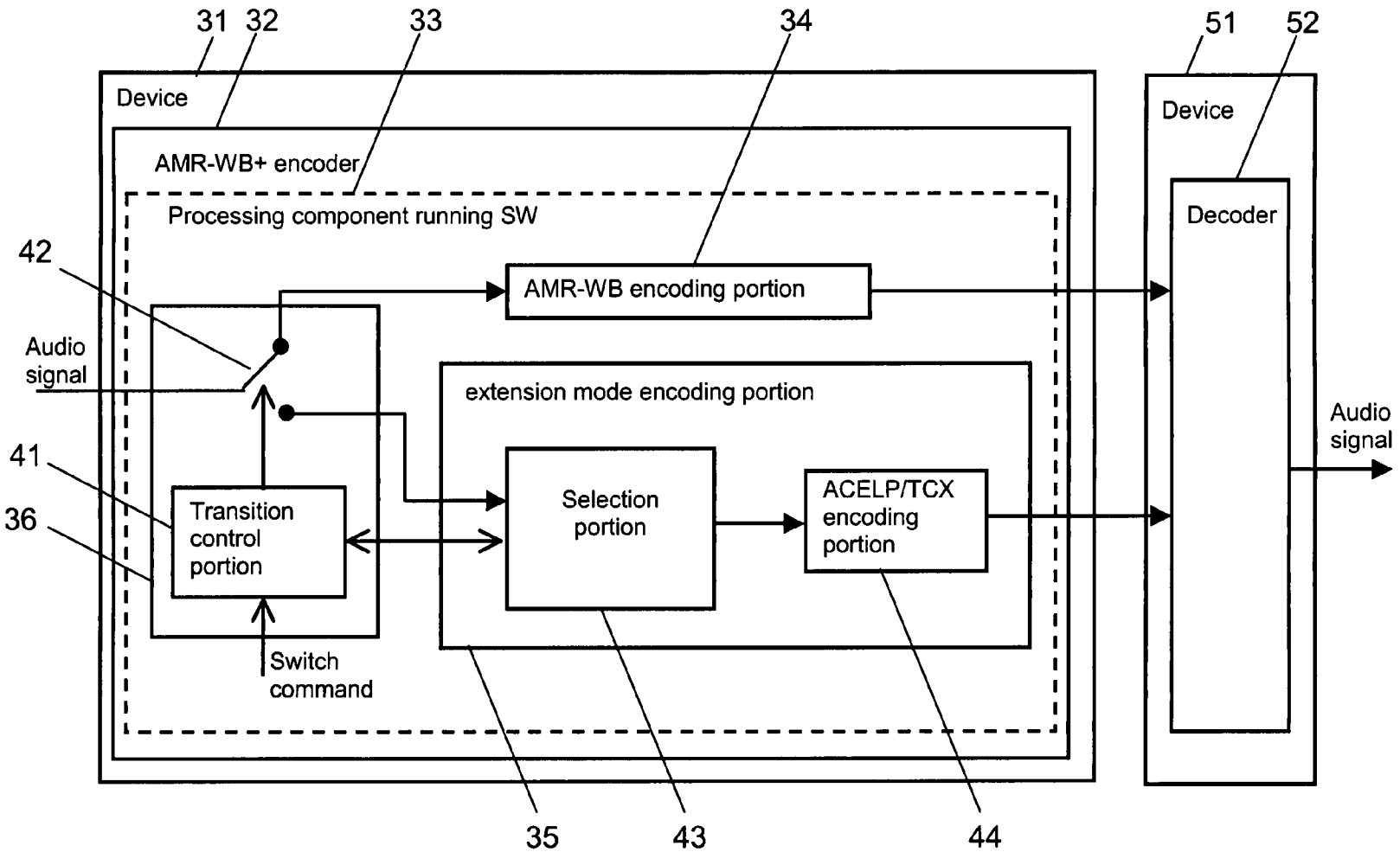
FIG. 3 is a schematic diagram of a system according to an embodiment of the invention.

FIG. 3 is a schematic diagram of an audio coding system according to an embodiment of the invention, which enables in an AMR-WB+ encoder a smooth transition between an AMR-WB mode and an extension mode.

The system comprises a first device 31 including the AMR-WB+ encoder 32 and a second device 51 including an AMR-WB+ decoder 52. The first device 31 can be for instance a mobile device or a non-mobile device, for example an MMS server. The second device 51 can be for instance a mobile phone or some other mobile device or, similarly, in some cases also a non-mobile device.

The AMR-WB+ encoder 32 comprises a conventional AMR-WB encoding portion 34, which is adapted to perform a pure ACELP coding, and an extension mode encoding portion 35 which is adapted to perform an encoding either based on an ACELP coding model or based on a TCX model.

The AMR-WB+ encoder 32 further comprises a switching portion 36 for forwarding audio signal frames either to the AMR-WB encoding portion 34 or to the extension mode encoding portion 35.

The switching portion 36 comprises to this end a transition control portion 41, which is adapted to receive a switch command from some evaluation portion (not shown). The switching portion 36 further comprises a switching element 42, which links a signal input of the AMR-WB+encoder 32 under control of the transition control portion 41 either to the AMR-WB encoding portion 34 or to the extension mode encoding portion 35.

The extension mode encoding portion 35 comprises a selection portion 43. The output terminal of the switching element 42 which is associated to the extension mode encoding portion 35 is linked to an input of the selection portion 43. In addition, the transition control portion 41 has a controlling access to the selection portion 43 and vice versa. The output of the selection portion 41 is further linked within the extension mode encoding portion 35 to an ACELP/TCX encoding portion 43.

It is to be understood that the presented portions 34 to 36 and 41 to 44 are designed for encoding a mono audio signal, which may have been generated from a stereo audio signal. Additional stereo information may be generated in additional stereo extension portions not shown. It is moreover to be noted that the encoder 32 comprises further portions not shown. It is also to be understood that the presented portions 34 to 36 and 41 to 44 do not have to be separate portions, but can equally be interweaved among each others or with other portions.

The AMR-WB encoding portion 34, the extension mode encoding portion 35 and the switching portion 36 can be realized in particular by a software SW run in a processing component 33 of the encoder 32, which is indicated by dashed lines.

Figure 4:
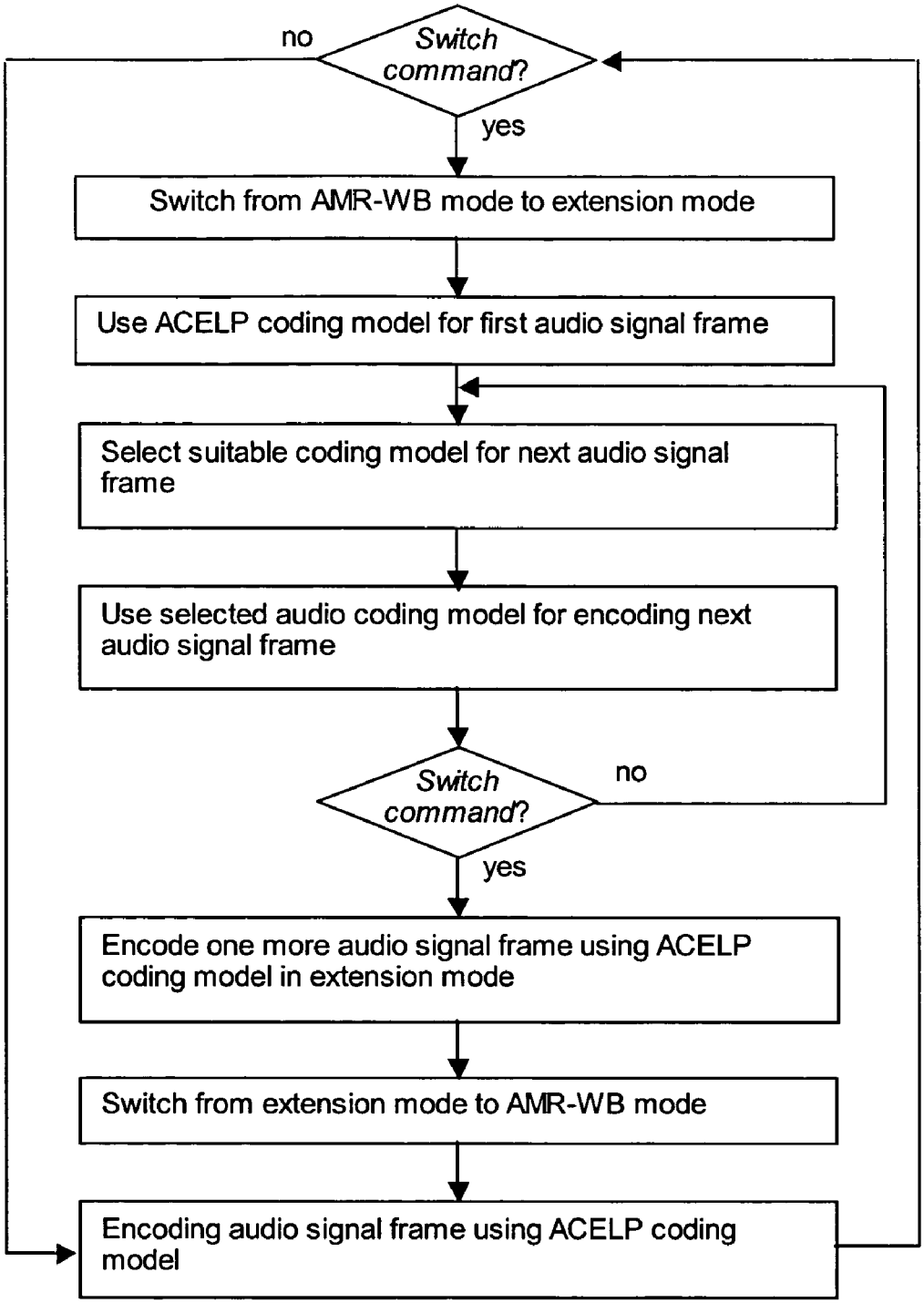
FIG. 4 is a flow chart illustrating the operation in the system of FIG. 3.

In the following, the processing in the AMR-WB+ encoder 32 will be described in more detail with reference to the flow chart of FIG. 4.

The AMR-WB+ encoder 32 receives an audio signal which has been provided to the first device 31. The audio signal is provided in frames of 20 ms to the AMR-WB encoding portion 34 or the extension mode encoding portion 35 for encoding.

The flow chart now proceeds from a situation in which the switching portion 36 provides frames of the audio signal to the AMR-WB encoding portion 34 for achieving a low output bit-rate, for example because there is not sufficient capacity in the network connecting the first device 31 and the second device 51. The audio signal frames are thus encoded by the AMR-WB encoding portion 34 using an ACELP coding model and provided for transmission to the second device 51.

Now, some evaluation portion of the device 31 recognizes that the conditions in the network change and allow a higher bit-rate. Therefore, the evaluation portion provides a switch command to the transition control portion 41 of the switching portion 36.

In case the switch command indicates a required switch from the AMR-WB mode to an extension mode, as in the present case, the transition control portion 41 forwards the command immediately to the switching element 42. The switching element 42 provides thereupon the incoming frames of the audio signal to the extension mode encoding portion 35 instead of to the AMR-WB encoding portion 34. In parallel, the transition control portion 41 provides an overrun command to the selection portion 42 of the extension mode encoding portion 35.

Within the extension mode encoding portion 35, the selection portion 43 determines for each received audio signal frame whether an ACELP coding model or a TCX model should be used for encoding the audio signal frame. The selection portion 43 then forwards the audio signal frame together with an indication of the selected coding model to the ACELP/TCX encoding portion 44.

When the selection portion 43 receives an overrun command from the transition control portion 41, it is forced to select an ACELP coding model for the audio signal frame, which is received at the same time. Thus, after a switch from the AMR-WB mode, the selection portion 43 will always select an ACELP coding model for the first received audio signal frame.

The first audio signal frame is then encoded by the ACELP/TCX encoding portion 44 in accordance with the received indication using an ACELP coding model.

Thereafter, the selection portion 43 determines for each received audio signal frame, either in an open-loop approach or in a closed-loop approach, whether an ACELP coding model or a TCX model should be used for encoding the audio signal frame.

The respective audio signal frame is then encoded by the ACELP/TCX encoding portion 44 in accordance with the associated indication of the selected coding model.

As known for the extension mode of AMR-WB+, the actual encoding of a respective ACELP is followed by the generation of an overlap signal, in case a TCX model is selected for the subsequent audio signal frame.

Since the first audio signal frame is encoded in any case using an ACELP coding model, it is therefore ensured that there is an overlap signal from the preceding audio signal frame already for the first TCX frame.

Figure 5:
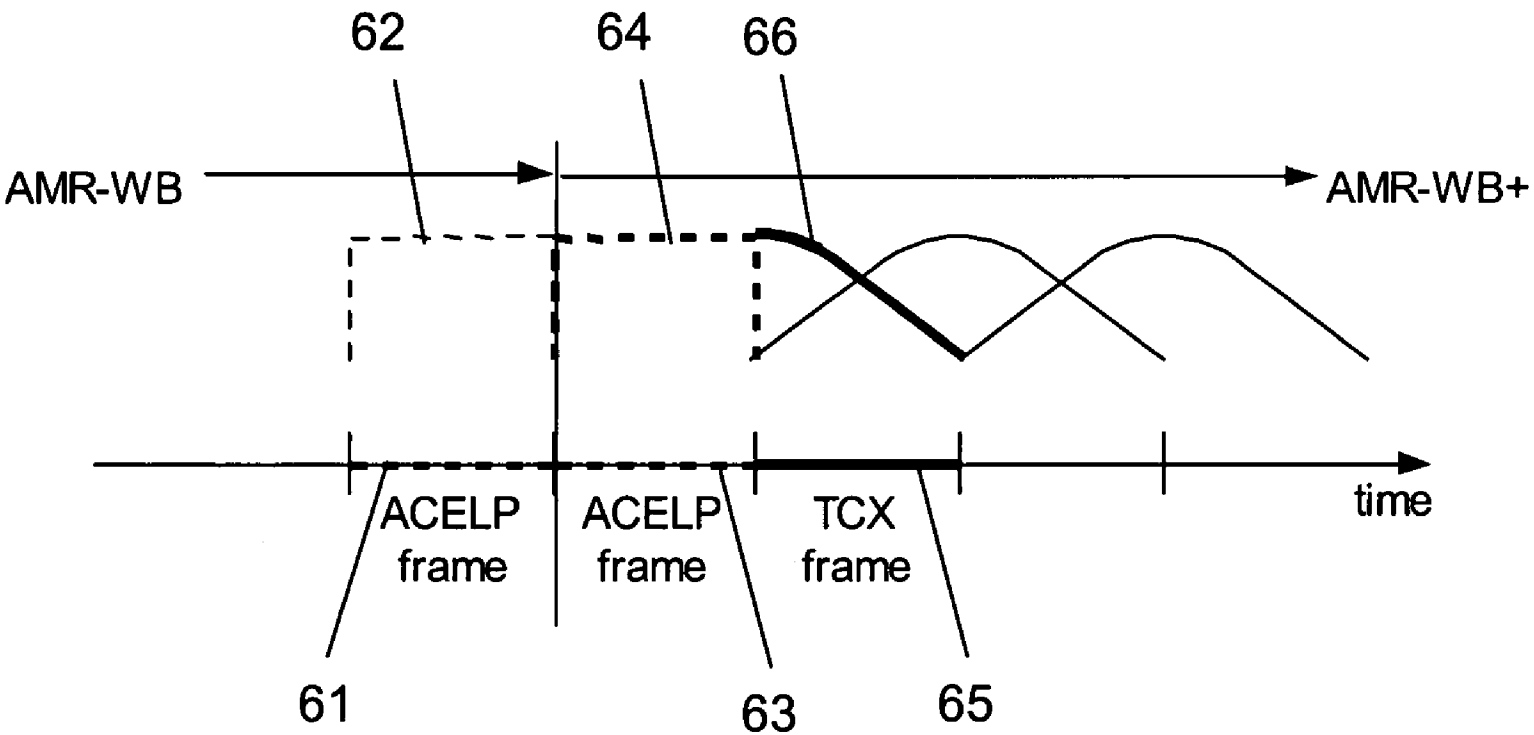
FIG. 5 is a diagram illustrating overlapping windows generated in the embodiment of FIG. 3.

The transition from the AMR-WB mode to the extension mode is illustrated in FIG. 5. FIG. 5 is a diagram presenting a time line with a plurality of coding frames which are dealt with before and after a switch from the AMR-WB mode to the extension mode. On the time line, the AMR-WB mode and the extension mode are separated by a vertical dotted line.

A coding frame 61 is the last ACELP coding frame which is encoded in the AMR-WB mode before the switch. The encoding of this ACELP coding frame 61 by the AMR-WB encoding portion 34 is not followed by the generation of an overlap signal. A subsequent coding frame 63 is the first coding frame which is encoded in the extension mode encoding portion 35 after the switch. This frame 63 is compulsorily an ACELP coding frame. The coding of both ACELP coding frames 61, 63 is based exclusively on information on the respective frame itself, which is indicated by dashed lines 62, 64.

The next coding frame 65 is selected by the selection portion 43 to be a TCX frame. The correct encoding of the TCX frame requires information from an overlapping window covering the TCX frame 65 and at least a part of the preceding ACELP coding frame 63. The encoding of the ACELP frame 63 is therefore followed by the generation of an overlap signal for this TCX frame 65, which is indicated in that the dashed lines 64 are dashed bold lines. The part of the overlapping window covering the TCX frame 65 is indicated by a curve 66 with a solid bold line.

It has to be noted that in case a TCX model can be selected by the selection portion 43 which uses a coding frame of more than 20 ms, for instance of 40 ms or of 80 ms, and requires a overlapping window covering more than one preceding audio signal frame, the selection portion 43 might also be forced to select an ACELP coding model for more than one audio signal frame after a switch.

If the evaluation portion of the device 31 recognizes later on that a lower bit-rate is needed again, it provides a further switch command to the switching portion 36.

In case the switch command indicates a switch from the extension mode to the AMR-WB mode, as in the present case, the transition control portion 41 of the switching portion 36 outputs immediately an overrun command to the selection portion 43 of the extension mode encoding portion 35.

Due to the overrun command, the selection portion 43 is forced again to select an ACELP coding model, this time for the next received audio signal frame for which a free selection is still possible. The audio signal frame is then encoded by the ACELP/TCX encoding portion 44 in accordance with the received indication using an ACELP coding model.

Further, the selection portion 43 transmits a confirmation signal to the transition control portion 41, as soon as the ACELP coding model can be selected for a currently received audio signal frame after the overrun command.

The extension mode encoding portion 35 will usually process received audio signal frames on the basis of a superframe of 80 ms comprising four audio signal frames. This enables the extension mode encoding portion 35 to use TCX frames of up to 80 ms, thus enabling a better audio quality. Since the timing of a switch command and the audio frame timing are independent from each other, the switch command can be given in the worst case during the encoding process just after the selection portion 43 has selected the coding model for the current superframe. As a result, the delay between the overrun command and the confirmation signal will often be at least 80 ms, since the ACELP coding mode can often be selected freely only for the last audio signal frame of the respectively next superframe.

Only after receipt of the confirmation signal, the transition control portion 41 forwards the switch command to the switching element 42.

The switching element 42 provides thereupon the frames of the incoming audio signal to the AMR-WB encoding portion 34 instead of to the extension mode encoding portion 35. The switching has thus a delay of at least one, but usually of several audio signal frames.

The delayed switching and the overrun command ensure together that the last audio signal frame encoded by the extension mode encoding portion 35 is encoded using an ACELP coding model. As a result, the quantization tools can be initialized properly before the switch to the AMR-WB encoding portion 34. Thereby, audible artifacts in the first frame after a switch can be avoided.

The AMR-WB encoding portion 34 then encodes the received audio signal frames using an ACELP coding model and provides the encoded frames for transmission to the second device 51, until the next switch command is received by the switching portion 36.

In the second device 51, the decoder 52 decodes all received encoded frames with an ACELP coding model or with a TCX model using an AMR-WB mode or an extension mode, as required. The decoded audio signal frames are provided for example for presentation to a user of the second device 51.

While there have been shown and described and pointed out fundamental novel features of the invention as applied to a preferred embodiment thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for encoding an audio signal, wherein at least a first coder mode and a second coder mode are available for encoding a respective section of said audio signal, said method comprising:

encoding via a second coder mode portion, a first section of an audio signal after a switch from said first coder mode to said second coder mode always using a first coding model, said second coder mode enabling a coding of a respective section of said audio signal based on at least two different coding models, wherein said first one of said coding models does not require for an encoding of a respective section of said audio signal information from a preceding section of said audio signal, and wherein a second one of said coding models requires for an encoding of a respective section of said audio signal an overlap signal with information from a preceding section of said audio signal;

selecting for further sections of said audio signal the respectively best suited coding model;

generating via said second coder mode portion, an artificial overlap signal based on information from said first section, at least in case said second coding model has been selected for encoding a subsequent section of said audio signal; and encoding said further sections using the respectively selected coding model.

2. The method according to claim 1, further comprising before a switch from said first coder mode to said second coder mode using said first coding model for encoding a last section of said audio signal before said switch.

3. The method according to claim 1, wherein said first coder mode is an adaptive multi-rate wideband mode of an extended adaptive multi-rate wideband codec, and wherein said second coder mode is an extension mode of said extended adaptive multi-rate wideband codec.

4. The method according to claim 1, wherein said first coding model is an algebraic code-exited linear prediction coding model and wherein said second coding model is a transform coding model.

5. A method for encoding an audio signal by an extended adaptive multi-rate wideband codec, wherein an adaptive multi-rate wideband mode and an extension mode are available for encoding a respective frame of said audio signal, said method comprising:

encoding via a second coder mode portion, a first frame of said audio signal after said switch from said adaptive multi-rate wideband mode to said extension mode always using an algebraic code-exited linear prediction coding model, said extension mode enabling a coding of a respective frame of said audio signal based on said algebraic code-exited linear prediction coding model and based on a transform coding model, wherein said transform coding model requires for an encoding of a respective frame of said audio signal an overlap signal with information from a preceding frame of said audio signal;

selecting for further frames of said audio signal the respectively best suited coding model;

generating via a second coder mode portion, an artificial overlap signal based on information from said first frame, at least in case said transform coding model has been selected for encoding a subsequent frame of said audio signal; and encoding said further frames using the respectively selected coding model.

6. An apparatus for encoding consecutive sections of an audio signal, said apparatus comprising:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to always select said first coding model for a first section of an audio signal after a switch to said second coder mode portion; and said second coder mode portion including an encoding portion which is configured to encode a respective section of an audio signal based on a coding model selected by said selection portion, and which is further configured to generate an artificial overlap signal with information from a first section of an audio signal after a switch to said second coder mode portion, at least in case said second coding model has been selected for encoding a subsequent section of said audio signal.

7. The apparatus according to claim 6, wherein said selection portion is further configured to select said first coding model for encoding a last section of said audio signal before a switch by said switching portion from said first coder mode to said second coder mode.

8. The apparatus according to claim 6, wherein said first coder mode portion is configured to encode a respective section of an audio signal in an adaptive multi-rate wideband mode of an extended adaptive multi-rate wideband codec, and wherein said second coder mode portion is configured to encode a respective section of an audio signal in an extension mode of said extended adaptive multi-rate wideband codec.

9. The apparatus according to claim 6, wherein said second coder mode portion is configured to use an algebraic code-exited linear prediction coding model as said first coding model and a transform coding model as said second coding model.

10. An electronic device comprising an encoder for encoding consecutive sections of an audio signal, which encoder comprises:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to select for a first section of an audio signal after a switch to said second coder mode portion always said first coding model; and said second coder mode portion including an encoding portion which is configured to encode a respective section of an audio signal based on a coding model selected by said selection portion, and which is further configured to generate an artificial overlap signal with information from a first section of an audio signal after a switch to said second coder mode portion, at least in case said second coding model has been selected for encoding a subsequent section of said audio signal.

11. The electronic device according to claim 10, wherein said electronic device is a mobile device.

12. The electronic device according to claim 10, wherein said electronic device is a mobile communication device.

13. An audio coding system comprising an encoder for encoding consecutive sections of an audio signal and a decoder for decoding consecutive encoded sections of an audio signal, wherein said encoder comprises:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to select for a first section of an audio signal after a switch to said second coder mode portion always said first coding model; and said second coder mode portion including an encoding portion which is configured to encode a respective section of an audio signal based on a coding model selected by said selection portion, and which is further configured to generate an artificial overlap signal with information from a first section of an audio signal after a switch to said second coder mode portion, at least in case said second coding model has been selected for encoding a subsequent section of said audio signal.

14. A processing component stored with software code for encoding an audio signal, wherein at least a first coder mode and a second coder mode are available for encoding a respective section of said audio signal, said software code executed by said processing component, causing said processing component to perform the following:

encoding a first section of said audio signal after a switch from said first coder mode to said second coder mode always using a first coding model, said second coder mode enabling a coding of a respective section of said audio signal based on at least two different coding models, wherein said first one of said coding models does not require for an encoding of a respective section of said audio signal information from a preceding section of said audio signal, and wherein a second one of said coding models requires for an encoding of a respective section of said audio signal an overlap signal with information from a preceding section of said audio signal;

selecting for further sections of said audio signal the respectively best suited coding model;

generating an artificial overlap signal based on information from said first section, at least in case said second coding model has been selected for encoding a subsequent section of said audio signal; and encoding said further sections using the respectively selected coding model.

15. A method for encoding an audio signal, wherein at least a first coder mode and a second coder mode are available for encoding a respective section of said audio signal, said method comprising:

encoding via a second coder mode portion a last section of said audio signal before a switch from said second coder mode to said first coder mode always using a first coding model, said second coder mode enabling a coding of a respective section of said audio signal based on at least two different coding models, wherein said first one of said coding models does not require for an encoding of a respective section of said audio signal information a preceding section of said audio signal, and wherein a second one of said coding models requires for an encoding of a respective section of said audio signal an overlap signal with information from a preceding section of said audio signal.

16. The method according to claim 15, wherein said first coder mode is an adaptive multi-rate wideband mode of an extended adaptive multi-rate wideband codec, and wherein said second coder mode is an extension mode of said extended adaptive multi-rate wideband codec.

17. The method according to claim 15, wherein said first coding model is an algebraic code-exited linear prediction coding model and wherein said second coding model is a transform coding model.

18. A method for encoding an audio signal by an extended adaptive multi-rate wideband codec, wherein an adaptive multi-rate wideband mode and an extension mode are available for encoding a respective frame of said audio signal, said method comprising:

encoding via a second coder mode Dortion a last section of said audio signal before a switch from said extension mode to said adaptive multi-rate wideband mode always using an algebraic code-exited linear prediction coding model, said extension mode enabling a coding of a respective frame of said audio signal based on said algebraic code-exited linear prediction coding model and based on a transform coding model, wherein said transform coding model requires for an encoding of a respective frame of said audio signal an overlap signal with information from a preceding frame of said audio signal.

19. An apparatus for encoding consecutive sections of an audio signal, said apparatus comprising:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to select for a last section of an audio signal before a switch to said first coder mode portion always said first coder model.

20. The apparatus according to claim 19, wherein said first coder mode portion is configured to encode a respective section of an audio signal in an adaptive multi-rate wideband mode of an extended adaptive multi-rate wideband codec, and wherein said second coder mode portion is configured to encode a respective section of an audio signal in an extension mode of said extended adaptive multi-rate wideband codec.

21. The apparatus according to claim 19, wherein said second coder mode portion is configured to use an algebraic code-exited linear prediction coding model as said first coding model and a transform coding model as said second coding model.

22. An electronic device comprising an encoder for encoding consecutive sections of an audio signal, which encoder comprises:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to select for a last section of an audio signal before a switch to said first coder mode portion always said first coder model.

23. The electronic device according to claim 22, wherein said electronic device is a mobile device.

24. The electronic device according to claim 22, wherein said electronic device is a mobile communication device.

25. An audio coding system comprising an encoder for encoding consecutive sections of an audio signal and a decoder for decoding consecutive encoded sections of an audio signal, wherein said encoder comprises:

a first coder mode portion configured to encode a respective section of an audio signal;

a second coder mode portion configured to encode a respective section of an audio signal; and a switching portion configured to switch between said first coder mode portion and said second coder mode portion for encoding a respective section of an audio signal;

said second coder mode portion including a selection portion configured to select for a respective section of an audio signal one of at least two different coding models, wherein a first one of said coding models does not require for encoding a respective section of an audio signal information from a preceding section of said audio signal, and wherein a second one of said coding models requires for encoding a respective section of an audio signal an overlap signal with information from a preceding section of said audio signal, said selection portion being further configured to select for a last section of an audio signal before a switch to said first coder mode portion always said first coder model.

26. A processing component stored with a software code for encoding an audio signal, wherein at least a first coder mode and a second coder mode are available for encoding a respective section of said audio signal, said software code executed by said processing component, causing said processing component to perform the following:

encoding a last section of an audio signal before a switch from said second coder mode to said first coder mode always using a first coding model, said second coder mode enabling a coding of a respective section of said audio signal based on at least two different coding models, wherein said first one of said coding models does not require for an encoding of a respective section of said audio signal information from a preceding section of said audio signal, and wherein a second one of said coding models requires for an encoding of a respective section of said audio signal an overlap signal with information from a preceding section of said audio signal.

27. An apparatus comprising:

first means for encoding a respective section of an audio signal;

second means for encoding a respective section of an audio signal; and means for switching between said first means and said second means for encoding a respective section of an audio signal;

said second means including means for selecting for a respective section of an audio signal one of at least two different coding models and for always selecting a first one of said coding models for a first section of an audio signal after a switch to said second means, wherein said first one of said coding models does not require for encoding a respective section of an audio signal information from a preceding section of said audio signal, and wherein a second one of said coding models requires for encoding a respective section of an audio signal an overlap signal with information from a preceding section of said audio signal; and said second means including means for encoding a respective section of an audio signal based on a coding model selected by said means for selecting, and for generating an artificial overlap signal with information from a first section of an audio signal after a switch to said second means, at least in case said second coding model has been selected for encoding a subsequent section of said audio signal.

28. An apparatus comprising:

first means for encoding a respective section of an audio signal;

second means for encoding a respective section of an audio signal; and means for switching between said first means and said second means for encoding a respective section of an audio signal;

said second means including means for selecting for a respective section of an audio signal one of at least two different coding models and for selecting for a last section of an audio signal before a switch to said first means always a first one of said first coder models, wherein said first one of said coding models does not require for encoding a respective section of an audio signal information from a preceding section of said audio signal, and wherein a second one of said coding models requires for encoding a respective section of an audio signal an overlap signal with information from a preceding section of said audio signal.

* * * * *

UNITED STATES PATENT AND TRADEMARK OFFICE

CERTIFICATE OF CORRECTION

PATENT NO. : 7,596,486 B2
APPLICATION NO. : 10/848971
DATED : September 29, 2009
INVENTOR(S) : Pasi Ojala et al.

It is certified that error appears in the above-identified patent and that said Letters Patent is hereby corrected as shown below:

At column 14, line 43, claim 18, line 6 please remove the word "Dortion" and replace it with the word --portion--.

Signed and Sealed this

Twenty-fourth Day of November, 2009

David J. Kappos

David J. Kappos
*Director of the United States Patent and Trademark Office*